US007399262B2

(12) United States Patent
Roger

(10) Patent No.: US 7,399,262 B2
(45) Date of Patent: Jul. 15, 2008

(54) METHOD FOR THE MANUFACTURE OF BAGS, THAT INCLUDES CUTS, AND THE CORRESPONDING BAG

(75) Inventor: Antony Roger, Sartrouville (FR)

(73) Assignee: S2F Flexico, Hononville (FR)

( * ) Notice: Subject to any disclaimer, the term of this patent is extended or adjusted under 35 U.S.C. 154(b) by 41 days.

(21) Appl. No.: 11/588,782

(22) Filed: Oct. 26, 2006

(65) Prior Publication Data

US 2007/0129229 A1 Jun. 7, 2007

(30) Foreign Application Priority Data

Oct. 28, 2005 (FR) ..... 05 11105

(51) Int. Cl.
*B31B 1/84* (2006.01)
*B31B 1/90* (2006.01)

(52) U.S. Cl. ..... 493/213; 493/212; 493/214; 493/927; 53/412; 53/133.4; 53/139.2; 383/64; 24/64; 29/408; 29/409; 29/768

(58) Field of Classification Search ..... 53/412, 53/133.4, 139.2; 493/212–214, 927; 383/64; 156/66; 24/64; 29/408–410, 768
See application file for complete search history.

(56) References Cited

U.S. PATENT DOCUMENTS

| | | | | |
|---|---|---|---|---|
| 5,431,760 | A * | 7/1995 | Donovan | 156/66 |
| 6,131,370 | A | 10/2000 | Ausnit | |
| 6,286,189 | B1 * | 9/2001 | Provan et al. | 24/30.5 R |
| 6,327,754 | B1 * | 12/2001 | Belmont et al. | 24/400 |
| 6,427,421 | B1 | 8/2002 | Belmont et al. | |
| 6,470,551 | B1 * | 10/2002 | Provan et al. | 29/408 |
| 6,517,473 | B1 * | 2/2003 | Cappel | 493/213 |
| 2003/0024080 | A1 | 2/2003 | Provan et al. | |

* cited by examiner

*Primary Examiner*—Hemant M. Desai
(74) *Attorney, Agent, or Firm*—Blakely, Sokoloff, Taylor & Zafman LLP

(57) ABSTRACT

A method for the manufacture of packaging bags, which includes a step of forming at least one bag in a scrolling film, welding opening and closing zippers that include a series of operating sliders onto the scrolling film, and effecting at least one cut in the zippers, where the length of the cut is greater than the length of each slider.

3 Claims, 3 Drawing Sheets

5
40
4
6
sach t 1
sachet 0
sachet 1
sach t 2
PRIOR ART

METHOD FOR THE MANUFACTURE OF BAGS, THAT INCLUDES CUTS, AND THE CORRESPONDING BAG

GENERAL TECHNICAL FIELD

This present invention concerns the manufacture of packaging bags that include opening and closing zippers equipped with sliders.

BACKGROUND

One is familiar with many methods for the manufacture of packaging bags that include opening and closing zippers equipped with sliders.

Figure 1:
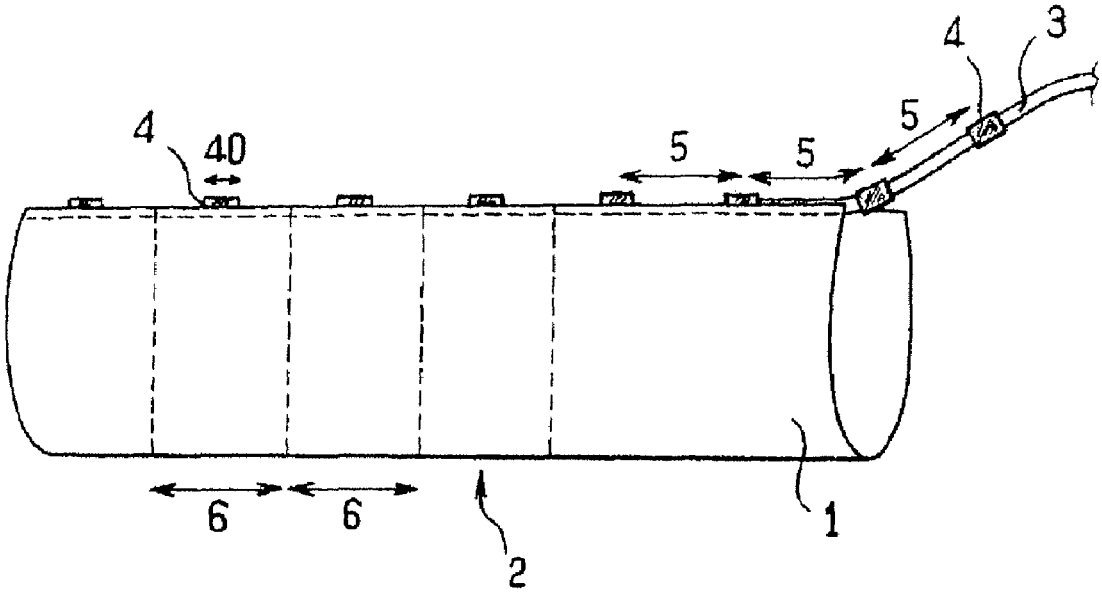
FIG. 1 PRIOR ART

FIG. 1 shows that some of these methods include a step that consists of forming bags 2 in a scrolling film 1, and a step that consists of welding, onto the bags 2 thus formed, opening and closing zippers 3 that include a series of operating sliders 4.

The opening and closing zippers 3 generally include additional zipper devices, and each slider 4 allow the opening or closing of a bag 2 by locking the zippers together, or not, as the slider is moved along the zippers.

On some packaging machines, it is preferable that the zippers 3 should be welded continuously.

Given the variations of pitch length 5 of the sliders 4 on the zippers 3 and the variations of pitch length 6 of the bags during manufacture, it is necessary of readjust each slider 4 to the desired pitch 6 of the bag 2.

To this end, the solution is to weld, onto the bags 2, zippers 3 that are equipped with sliders 4 whose pitch 5 is slightly less than the pitch 6 of the bags 2, so that with the tolerances in the pitch 5 and 6, the maximum length 40 of a zipper fitted with a slider 4 is always less than the minimum pitch dimensions 6 of a bag 2.

Figure 2:
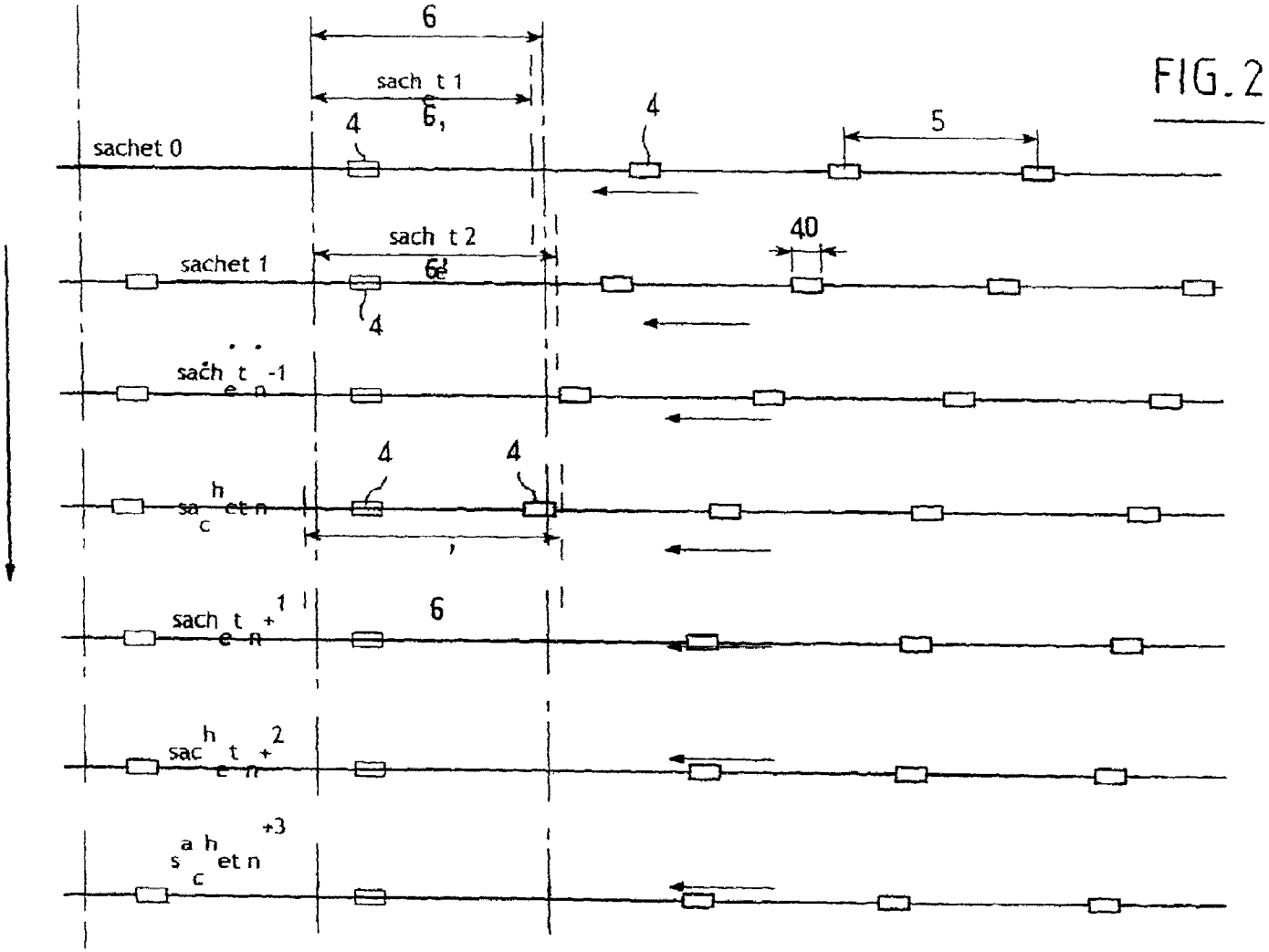

However, as shown in FIG. 2, by readjusting the slider 4 to the pitch 6 of the bag 2, then after the manufacture of n bags, one finds oneself with two sliders 4 on one bag 2 in rank n. In fact one has a bag width 6' that differs from the desired pitch 6 of the bags.

Currently, the bag 2 in rank n is marked as defective and ejected from the production line.

This creates a rupture in the production chain which in fact it is desired should be continuous.

This also causes the loss of the whole bag, and therefore a manufacturing overcost if this happens very often.

PRESENTATION OF THE INVENTION

The invention proposes to overcome at least one of the drawbacks of the prior art.

To this end, the invention proposes a method for the manufacture of packaging bags that include a step that consists of:

forming at least one bag from a scrolling film, welding, onto the scrolling film, of opening and closing zippers that include a series of operating sliders, making at least one cut in the zippers, where the length of the cut is greater than the length of each slider, characterised in that it includes a step that consists of:

ejecting a slider from the zippers via a cut.

The invention is advantageously completed by the following characteristics, taken alone or in any of their combinations that are technically possible:

the zipper cutting step is executed regularly along the zippers, with each cut being separated from the other cuts by a distance that is a multiple of a bag pitch length;

the method also includes a step that consists of positioning a slider close to a cut in the zippers;

the ejection step is effected when there is more than one slider on the zippers for a given bag.

The invention has many advantages.

The invention ensured that there is only a single operating slider on a bag.

It is used to avoid a rupture in the production chain, and therefore a manufacturing overcost. Only the slider is lost, and not all of the bag as is the case in the prior art.

The ejection of a superfluous slider on a bag is effected easily.

The cutting of the zippers avoids having excess thickness at the lateral weld zone of the bags. Welding is therefore effected in a more efficient manner, and the sealing of the bag is reinforced.

PRESENTATION OF THE FIGURES

Figure 4:
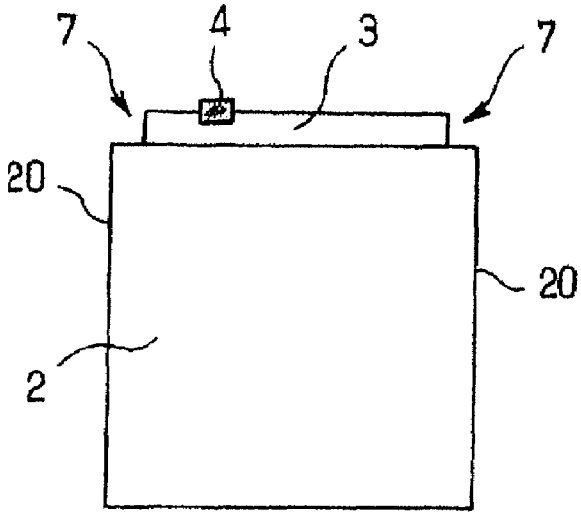
Figure 3:
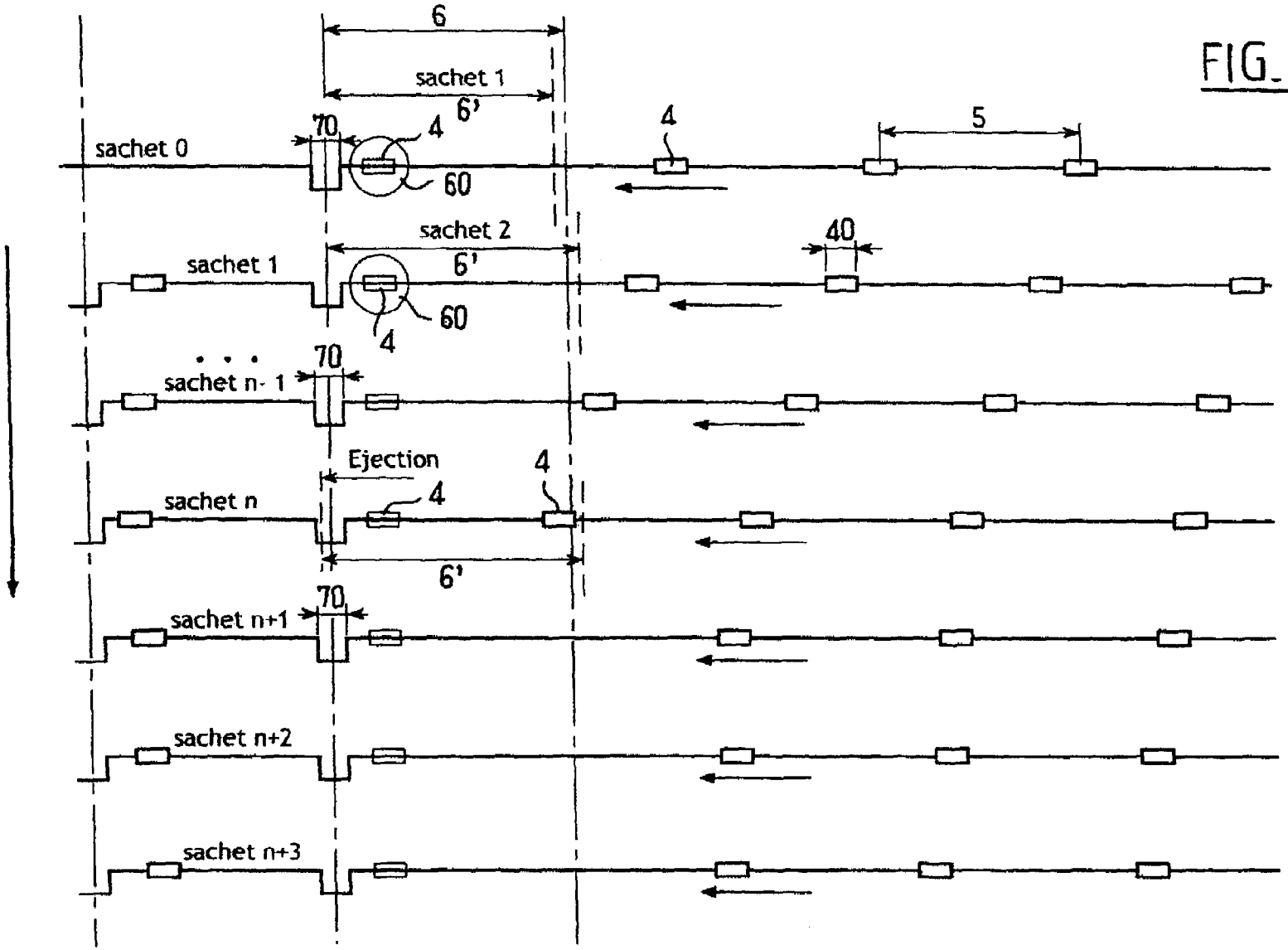

Other characteristics, aims and advantages of the invention will emerge from the description that follows, and which is purely illustrative and non-limiting, and which should be read with reference to the appended drawings in which:

FIG. 1, already commented upon, schematically shows a few steps of a known method for the manufacture of packaging bags;

FIG. 2, already commented upon, schematically shows the implementation of a known method for the manufacture of packaging bags for n+3 bags shown vertically in succession;

FIG. 3 schematically shows the implementation of a method according to the invention for n+3 bags shown vertically in succession; and FIG. 4 shows a bag manufactured by a method according to the invention.

On all of the figures, similar elements have identical numerical references.

DETAILED DESCRIPTION

Conventionally, a method for the manufacture of packaging bags 2 according to the invention includes a step that consists of forming at least one bag 2 in a scrolling film 1, and of welding, onto the scrolling film, opening and closing zippers 3 that include a series of operating sliders 4. Such a step is of the type that has been described with reference to FIG. 1, and is not described here for reasons of brevity.

Likewise, the zippers 3 and the sliders 4 are conventional, and are not described in detail in thus present description. The sliders 4 are presents on the zippers 3 at a given pitch 5.

After welding of the zippers onto the scrolling film, the method of manufacture includes a step for filling the bags and a lateral welding step to individualise the bags 2. The filling and lateral welding step can be effected in any order in relation to each other, and be effected on one given machine or on a different machine.

It can be seen that the lateral welding is effected at a given pitch 6 on the bags, but due to tolerances in particular, the bags 2 have a width 6' that can be different from the wanted pitch interval 6.

FIG. 3 shows that the method includes a step that consists of effecting at least one cut 7 in the zippers 3 welded onto the scrolling film, preferably before the filling step and the lateral welding step.

By successive vertical superimposition of the n+3 bags 2, FIG. 3 also shows that the step for cutting the zippers 3 is executed regularly along the zippers. Each cut 7 is separated from the other cuts 7 by a distance that is a multiple of the pitch 6 of the bags 2.

Very preferably, the cut 7 is at a lateral welding zone. Thus, as shown in FIG. 4, a bag 2 made using the method according to the invention includes a cut 7 at each end of the zippers 3. The cut 7 in the zippers 3 avoids having excess thickness at the lateral welding zone 20 of the bags. Welding is therefore effected in a more efficient manner, and the sealing of the bag is reinforced.

The method also includes a step that consists of positioning each slider 4 on the zippers 3. Preferably, the slider 4 is positioned in a repositioning zone 60 close to a cut 7.

FIG. 3 shows that, due to the variations in the pitch 6 of the bags, causing a difference of width 6' between the bags, as well as the variations in the pitch 5 of the sliders 4, it happens that several sliders 4 can be positioned on the zippers 3 for one given bag 2. This is the case of the example of the bag 2 of rank n in FIG. 3.

In this case, the method also includes a step that consists of ejecting a slider 4 from the zippers 3 by means of a cut 7. As a result of this ejection, there is only one operating slider on any one bag.

The ejection step is used to avoid a rupture in the production chain and therefore a manufacturing overcost. Only the slider is lost, and not all of the bag as is the case in the prior art.

The ejection of a superfluous slider from a bag is effected easily. In fact, the length 70 of the cut 7 is greater than the length 40 of each slider 4.

The invention claimed is:

1. A method for manufacturing packaging bags including the steps of:

providing a scrolling folded film;

welding, onto the scrolling folded film, opening and closing zippers that include a series of operating sliders at a predetermined pitch;

making cuts in the zippers, wherein each cut is separated from the other cuts by a distance that is a multiple of a pitch of the bags and each cut having a length greater than the length of each slider;

forming at least one bag in the scrolling folded film by lateral welding; and ejecting the slider from the zippers by means of the cut when there is more than one slider on the zippers of said bag.

2. The method of claim 1, wherein the step of cutting the zippers is performed regularly along the zippers, with each cut being separated from the other cuts by a distance that is a multiple of the pitch of the bags.

3. The method according to one of the preceding claims, further comprising a step that consists of positioning a slider close to a cut on the zippers.

* * * * *